United States Patent [19]

Iven

[11] 4,063,614

[45] Dec. 20, 1977

[54] COMBINATION LOUDSPEAKER AND SIGN HOLDER

[76] Inventor: Gerd H. Iven, 20 Josaly Drive, West Hill, Ontario, Canada, M1C 2N5

[21] Appl. No.: 743,885

[22] Filed: Nov. 22, 1976

[30] Foreign Application Priority Data

Dec. 4, 1975 Germany ..... 7538667[U]

[51] Int. Cl.[2] ..... H04R 11/02

[52] U.S. Cl. ..... 181/152; 40/28.1; 181/180; 181/199

[58] Field of Search ..... 40/28.1; 179/1 E, 115.5 H; 181/148, 152, 159, 177, 178, 192, 199, 180

[56] References Cited

U.S. PATENT DOCUMENTS

| | | | |
|---|---|---|---|
| 2,084,808 | 6/1937 | Hyde | 40/28.1 |
| 2,386,996 | 10/1945 | Williams | 181/148 |
| 3,048,083 | 8/1962 | Rosenbaum | 40/28.1 |
| 3,848,090 | 11/1974 | Walker | 179/1 E |

*Primary Examiner*—George G. Stellar
*Attorney, Agent, or Firm*—Rogers, Bereskin and Parr

[57] ABSTRACT

A combination loudspeaker and sign holder having a housing which has enlarged flat parallel end walls joined by narrow end walls. Within the housing is an acoustic horn having a vertical axis and horn end walls diverging downwardly and outwardly. The horn end walls are secured to the housing side walls, and the horn side walls are constituted by the housing side walls. Atop the horn is a speaker which radiates downwardly through the horn and the open bottom of the housing. Preferably the horn end and top walls are formed by a single bent strip of corrugated plastic and the housing is formed of the same material. Tabs in the housing allow it to be suspended from a store ceiling, and a sleeve bearing advertising material may be fitted over the housing. Alternatively, advertising material may be attached to the sides of the housing.

4 Claims, 11 Drawing Figures

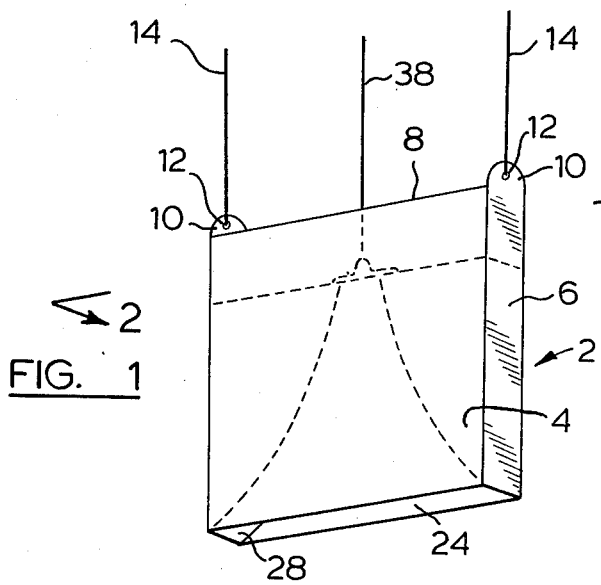
FIG. 1
FIG. 1a
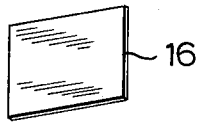
FIG. 1b
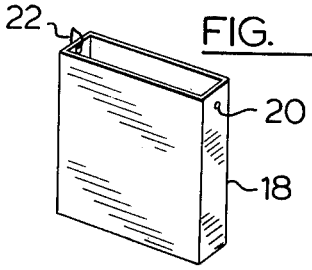
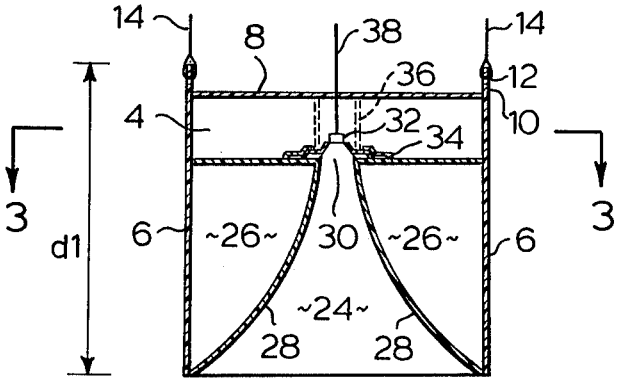
FIG. 2
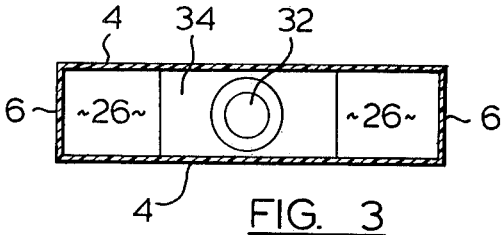
FIG. 3
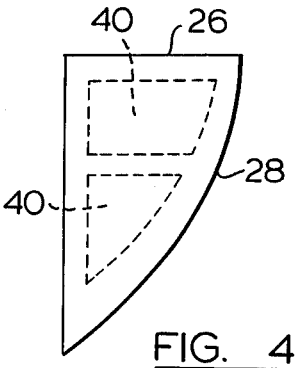
FIG. 4
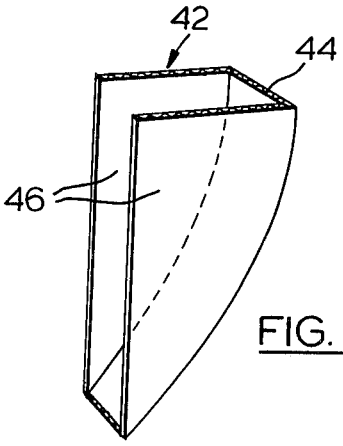
FIG. 5

COMBINATION LOUDSPEAKER AND SIGN HOLDER

This invention relates to a loudspeaker and sign holder combination.

It is often desired, in supermarkets and other merchandising areas, to hang display signs where they will be visible from large portions of the merchandising area. Such display signs are usually expensive. In addition, it is usually desired in supermarkets and other large merchandising areas to provide a public address system over which announcements may be made and over which music may be played. The public address systems are usually provided in the form of expensive built-in speaker systems.

Accordingly, it is the object of the invention to provide an inexpensive, easily constructed loudspeaker and sign holder combination which may be suspended in large merchandising areas, and which permits display of advertising material, and which also permits effective sound radiation over a substantial portion of the merchandising area. In a preferred embodiment of the invention, this is achieved by providing a loudspeaker and sign holder combination having a housing which has a pair of enlarged flat parallel side walls, a pair of flat narrow end walls connecting the ends of the side walls, and an open bottom. An acoustic horn having a vertical axis is located within the housing. The horn has a pair of horn end walls one on each side of the vertical axis and extending between the housing side walls. The horn end walls are spaced apart at their tops to define an aperture, and they diverge outwardly and downwardly toward the open bottom of the housing. A speaker is mounted over the aperture in the horn to radiate sound out the open bottom of the housing. Means are provided for suspending the housing with its open bottom facing downwardly, so that the housing acts as a sign holder and also as an effective part of a speaker system.

Further objects and advantages of the invention will appear from the following description, taken together with accompanying drawings, in which:

FIG. 1 is a perspective view of a first embodiment of the invention;

FIG. 1*a* is a perspective view of an advertising sign which may be mounted on the FIG. 1 structure;

FIG. 1*b* is a perspective view of another advertising sign which may be mounted on the FIG. 1 structure;

FIG. 2 is a longitudinal section taken along lines 2—2 of FIG. 1;

FIG. 3 is a cross-section along lines 3—3 of FIG. 2;

FIG. 4 is a side elevation of a rigid foam insert for the structure of FIG. 1;

FIG. 5 is a perspective view of a cardboard strip insert for the structure of FIG. 1;

Figure 6:
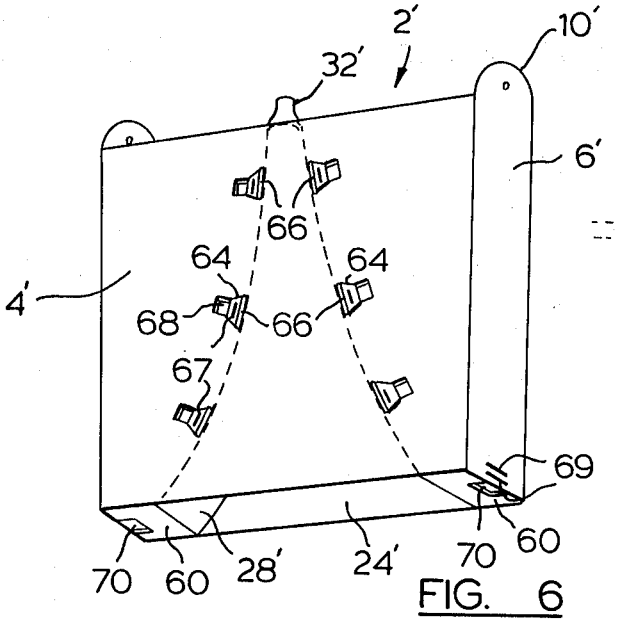
FIG. 6 is a perspective view of a further embodiment of the invention.
Figure 6A:
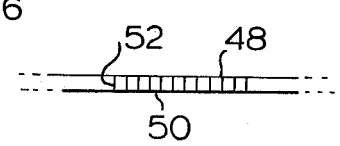
Figure 7:
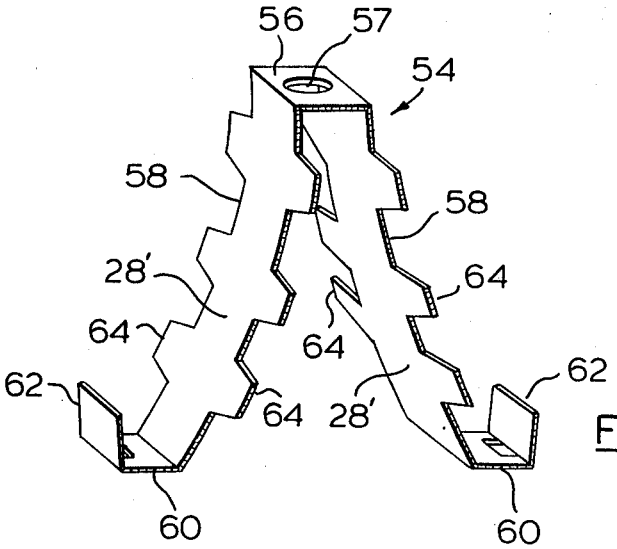
Figure 8:
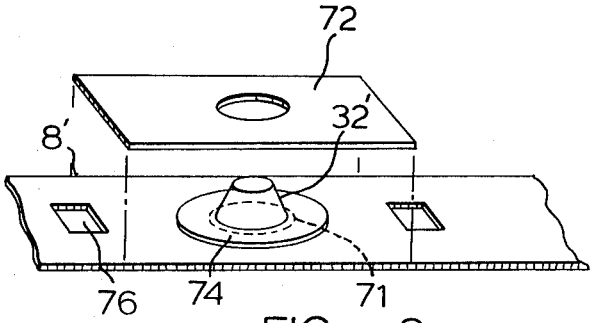

FIG. 6*a* is an end view of a corrugated plastic sheet which may be used in the FIG. 6 structure;

FIG. 7 is a perspective view of a strip which forms the end walls of a horn of the FIG. 6 structure; and FIG. 8 is a perspective view of a speaker and retaining strip for the FIG. 6 structure.

Reference is first made to the embodiment of the invention shown in FIGS. 1 to 4. As shown, this embodiment comprises a relatively flat rectangular housing 2 made of folding corrugated cardboard. The housing 2 includes a pair of enlarged flat parallel side walls 4, a pair of end walls 6 which connect the ends of the side walls, and a top wall 8 joining the tops of the side walls. The end walls 6 include a pair of tabs 10 projecting from their upper ends. The tabs 10 have holes 12 therein so that the housing 2 may be suspended from the ceiling or from a suitable mounting by suspending wires 14.

The housing 2 is adapted to carry an advertising display. The advertising display may be in the form of flat sheets 16 (FIG. 1*a*) which are adhered to the side walls 4 of the housing 2 by adhering means such as that known under the trade mark Velcro, or by staples. Alternatively the advertising display may take the form of a rectangular hollow sleeve 18 (FIG. 1*b*) which is slid over the housing 2. The height of the sleeve 18 may equal to the dimension dl between the bottom of the end walls 6 and the top of the tabs 10, so as to cover the tabs. The sleeve 18 may have holes 20 in its upper end walls which are aligned with the holes 12 in the tabs. Flexible ties 22 may be inserted through the aligned holes 20, 12 to prevent the sleeve 18 from falling off the housing 2.

Located within the housing 2 is an acoustic horn 24, formed by two opposed rigid polystyrene inserts 26. The sides 28 of the inserts 26 diverge, from their tops to their bottoms, exponentially outwardly and downwardly to form an exponential acoustic horn. The inserts are spaced apart at their tops to form an upper aperture 30, and they are secured to the cardboard walls of the housing 2 by any desired means, preferably by glue.

The aperture 30 at the top of the inserts 26 is bridged by a loudspeaker 32. Speaker 32 is secured, in a soundproof manner to the tops of the inserts 26 by means of a fastening plate 34, the ends of which are secured to the backs of the foam inserts 26. Alternatively, an annular spacer 36, shown in dotted lines, may be provided extending between the top wall 8 and the speaker 32 to press the speaker against the tops of the elements 26. The speaker 32 is energized through a wire 38.

In use, the housing 2 is hung from a store ceiling or in any suitable location, by the wires 14. Advertising is displayed on the housing, and sound is radiated through the horn 24 and out the bottom of the housing by the speaker 32. The advertising can readily be changed, and in fact the entire housing is so inexpensive that the advertising can be printed directly on the exterior of the housing and the housing discarded when the advertising has become outdated.

If desired, to save material, the foam inserts may be provided with cutouts 40, as shown in FIG. 4.

FIG. 5 shows a corrugated cardboard insert 42 designed to be glued to the housing 2 between the side walls 4 in place of the foam inserts 26. The corrugated cardboard insert 42 has an end wall 44 which forms an end wall of the horn 24, and side walls 46 which are secured to the side walls 4 of the housing 2.

Reference is next made to FIG. 6 to 8, which show an embodiment of the invention particularly suitable for use with a corrugated plastic material sold under the trade mark COROPLAST. As shown in FIG. 6*a*, this corrugated plastic is almost identical with corrugated cardboard, having a pair of flat top and bottom surface sheets 48, 50, separated by a large number of parallel strips 52. However, this corrugated plastic material is extruded as a single integral unit and is exceedingly strong and stiff and can be printed one, while at the same time being light and relatively inexpensive. The material is therefore ideally suited for use with the invention.

As shown in FIGS. 6 and 7, in which primed reference numerals indicate parts corresponding to those of FIG. 1 to 4, the exponential horn 24' may be formed by a single strip 54 of corrugated plastic. The strip 54 is bent into the shape of an exponential horn and includes a top wall 56 having a central opening 57, exponentially diverging end walls 58, horizontal portions 60, and upstanding tabs 62. Projecting from the sides of the exponentially curved end walls 58 are connecting tabs 64.

The housing 2' of FIG. 6 is made of corrugated plastic and is formed as a blank which is stapled into the box shape shown. During assembly, the connecting tabs 64 of the strip 54 are inserted through slits 66 in the side walls 4' of the housing 2', bent over, and stapled at 67. The stapler (not shown) is inserted through openings 68 which are provided for this purpose in the side walls 4'. The openings 68 are provided in the areas of the side walls 4' which do not form part of the side walls of the horn 24'. to prevent degradation of the horn's performance. In addition, the upstanding tabs 62 are stapled at 69 to the end walls 6' of the housing 2' through openings 70 formed in the horizontal portions 60 for this purpose. The dimensions are made such that top wall 56 of the strip 54 abuts against the top wall 8' of the housing 2'. Top wall 8' is provided with an opening 71 (FIG. 8) in registry with opening 57 in top wall 56 of the strip 54.

The loudspeaker 32' may be secured to the top wall 8' of the housing 2', over the openings 57, 71, by any desired means. Typically a rectangular retaining member 72 (FIG. 8) is provided, having an opening therein which fits over the loudspeaker magnet and covers the loudspeaker retaining ring 74. The ends of the retaining member 72 are stapled to the top wall 8' of the housing 2' through openings 76 in the top wall 8' which are provided for this purpose.

In use, since the housing 2' is hung with the horn opening downwardly, sound is radiated downwardly and outwardly to cover a large area below the housing 2'. New display signs can readily be attached to the housing 2' (or can be printed on the surface of the housing itself). The housing 2' is extremely inexpensive and easy to assemble, and its loudspeaker can easily be removed and the housing discarded if the housing suffers damage.

If desired, the open bottom of the housing 2 or 2' may be covered by an acoustically transparent cloth or a screen, but because of the narrowness of the housing 2 or 2' (typically 4 inches or less, whereas the sidewalls may be several feet in length) and because of the smooth and the pleasing appearance of the tapered horn within the housing, such covering will not normally be necessary (and it would add to the expense of the unit).

The use of an exponential horn, which is extremely inexpensively formed, is advantageous because exponential horn speakers deliver more sound volume from less input wattage than do most other speakers, and their sound quality is generally superior to that of other speakers.

What I claim is:

1. A loudspeaker and sign holder combination comprising:

a. a housing having a pair of enlarged flat parallel side walls, a pair of flat narrow end walls connecting the ends of said side walls, a top wall and an open bottom, said side, end and top walls all being formed of a corrugated plastic material, each end wall having a portion projecting above said top wall to form a vertically extending end tab at the top of each end wall, b. an acoustic horn within said housing, said horn having a vertical axis and a pair of horn end walls one on each side of said axis, said horn end walls extending between said housing side walls, one on each side of said axis, said horn end walls also being formed of said corrugated plastic material and being spaced apart at their tops to define an aperture at the top of said horn and diverging outwardly and downwardly toward said open bottom of said housing, c. a speaker mounted at the top of said horn over said aperture, d. an advertising display sign sleeve encircling and covering said housing, said sleeve being open at its bottom to permit sound to be radiated therethrough and also being open at its top, said sleeve covering said end tabs, e. each end tab having a hole therein for a suspending cable to pass therethrough, said sleeve having a pair of holes adjacent its upper end, one aligned with each of the holes in said end tabs, also to allow said suspending cable to pass therethrough, f. and a suspending cable extending through said holes in said sleeve and end tabs at each end of said housing for suspending said housing in the air with the bottom thereof hanging downwardly and also for retaining said sleeve to said housing.

2. Apparatus according to claim 1 wherein the sides of said horn are constituted by said side walls of said housing and wherein said horn end walls are formed by a single elongated rectangular strip of said corrugated plastic material bent to a horn-shape and having (i) a top wall having said aperture therein, (ii) a pair of diverging walls which constitute said horn end walls, and (iii) tabs extending laterally outwardly from said horn end walls, said tabs extending through said side walls and being bent parallel with said side walls and being secured thereto.

3. Apparatus according to claim 2 wherein said strip includes a pair of bottom portions, one at each end of a said horn end wall, said bottom portions being secured to said housing end walls.

4. Apparatus according to claim 2 including a loudspeaker retaining member of corrugated plastic, said loudspeaker retaining member being a flat rectangular member having an aperture therein through which the rear of said loudspeaker projects, said retaining member being mounted over said top wall of said horn.

* * * * *